US005347345A

United States Patent [19]

Osterhoudt

[11] Patent Number: 5,347,345

[45] Date of Patent: Sep. 13, 1994

[54] METHOD AND APPARATUS OF CREATING TWO-COLOR IMAGES IN A SINGLE PASS

[75] Inventor: Hans W. Osterhoudt, Spencerport, N.Y.

[73] Assignee: Eastman Kodak Company, Rochester, N.Y.

[21] Appl. No.: 963,444

[22] Filed: Oct. 19, 1992

[51] Int. Cl.[5] ..... G03G 21/00

[52] U.S. Cl. ..... 355/246; 355/251; 355/268; 355/326 R; 355/328; 430/42; 430/45; 430/54

[58] Field of Search ..... 430/42, 45, 54; 355/246, 251, 268, 326, 328

[56] References Cited

U.S. PATENT DOCUMENTS

| | | | |
|---|---|---|---|
| 4,078,929 | 3/1978 | Gundlach | 96/1.2 |
| 4,961,094 | 10/1990 | Yamaoki et al. | 355/326 |
| 5,030,531 | 7/1991 | Goodman | 430/45 |
| 5,132,730 | 7/1992 | Hurwitch et al. | 355/246 |

*Primary Examiner*—John Kight, III
*Assistant Examiner*—Duc Truong
*Attorney, Agent, or Firm*—Leonard W. Treash, Jr.

[57] ABSTRACT

Two-color images are created in a single pass by forming an electrostatic image having three levels of electrostatic potential, low, intermediate and high. Toner of a first color is applied to the image in the presence of an electric field urging the toner toward one of the levels of potential. A second toner is applied to the electrostatic image having a second color, but of the same polarity as the first toner, in the presence of a second electric field urging the second toner both toward the areas that have been toned by the first toner and toward one of the other levels of potential. If the first toner is of a dark color and is used for text and the second color is the light color used for highlighting, a quality two-color image can be made in a single pass using toners of the same polarity.

3 Claims, 2 Drawing Sheets

METHOD AND APPARATUS OF CREATING TWO-COLOR IMAGES IN A SINGLE PASS

This invention relates to the creation of a two-color toner image on an image member in a single pass of the image member past a series of stations. Although not limited thereto, it is particularly useful in making an image in which text is printed in a black or other dark color and portions of the text are highlighted with yellow or another light color.

U.S. Pat. No. 4,078,929 to Gundlach and U.S. Pat. No. 5,030,531 to Goodman are two of a large number of patents which describe a two-color printing system called tri-level xerography. In this system, a photoconductive element is exposed to three levels of radiation. The text areas of an original are imaged with very little radiation and highlight areas, or a second color of text, are imaged with highest radiation with the background at an intermediate radiation. This provides an electrostatic image of high, medium and low potentials. The image is developed by application of two toners of opposite polarity, usually from two different toning stations. One polarity of toner is attracted to the high potential portion and another polarity to the low potential portion. With use of appropriate bias, the medium potential portion is untoned. This can be used to provide text in black and red with a white background or it can be used to provide a text in black with yellow highlighting and virtually every other two-color scheme desired.

A problem with this system is that the resulting image contains toners of opposite polarities. Since conventional transfer of toner to a receiving sheet is accomplished electrostatically, any transfer field will direct some toner toward the receiving sheet and other toner away from the receiving sheet. The traditional solution to this problem is to change the polarity of the toner of the image after development by applying a high voltage corona of one polarity or the other. This requires both use of toners that readily accept a change in charge, and an additional component in the apparatus.

It would be quite desirable to eliminate the necessity of this charge adjustment step.

SUMMARY OF THE INVENTION

It is an object of the invention to create two-color images in a single pass using toners of the same polarity.

These and other objects are accomplished by a method in which an electrostatic image is formed having at least three levels of electrostatic potential. A first toner having a first color and a first polarity is applied to the image in the presence of a first electric field urging the first toner away from two of the three levels of potential and toward the other level of potential. A second toner of a second color but of the same first polarity is applied to the image in the presence of a second electric field urging the second toner away from only one of the levels of potential and toward at least one of the levels.

Using this method, a two-color toner image is created with both color toners having the same polarity. This permits electrostatic transfer without a need to adjust the charge of any of the toner.

This method is particularly usable when the first toner is of a dark toner and is used for text material, while the second toner is of a light color and is used to highlight the text. For example, it is particularly usable with a black toner used for text and a yellow toner used for highlight.

DESCRIPTION OF THE PREFERRED EMBODIMENTS

Figure 1:
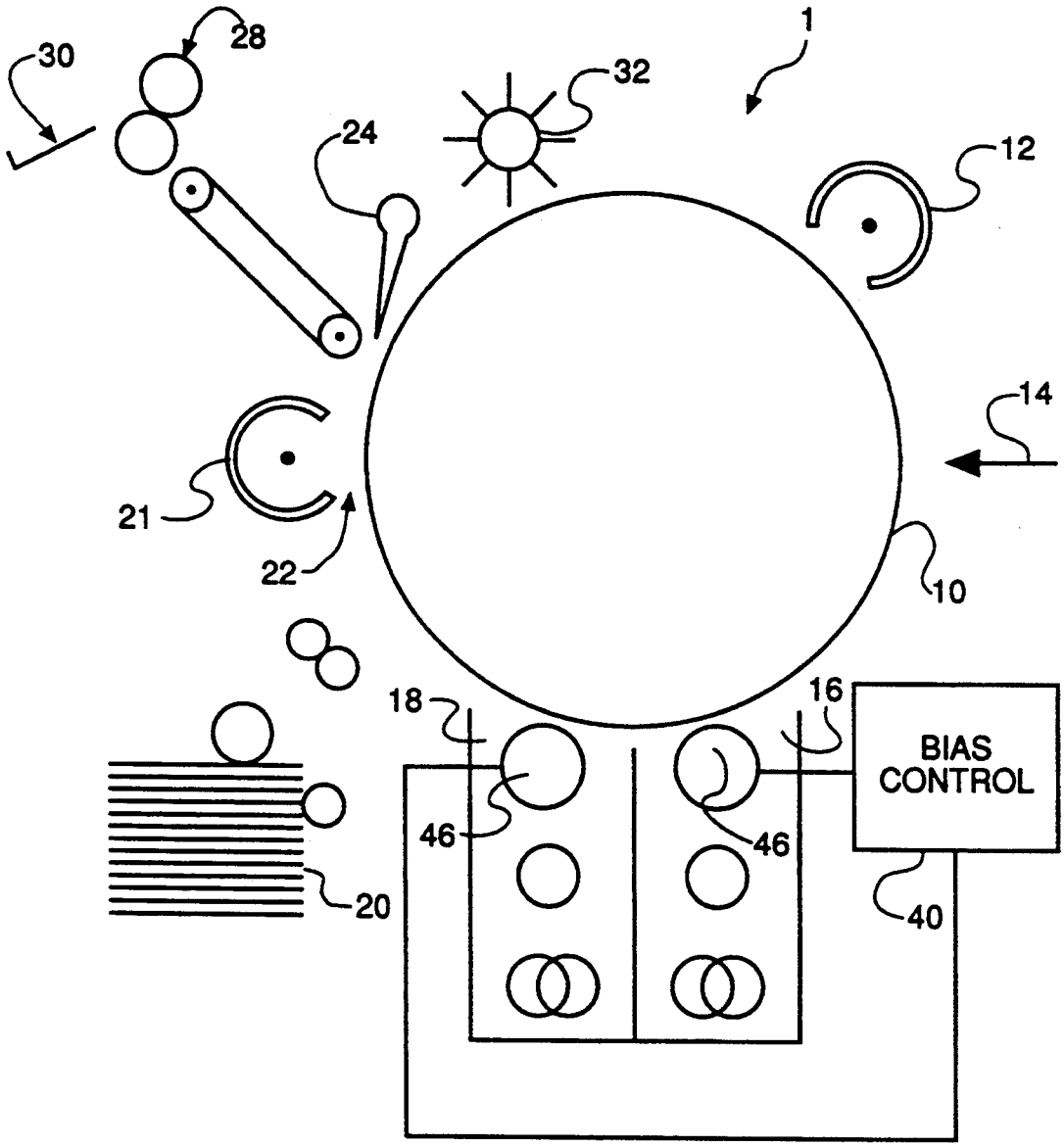
FIG. 1 is a schematic of an image forming apparatus.

FIG. 1 shows an image foraging apparatus in which the invention is usable. An image member 10, for example, a photoconductive drum, is uniformly charged by a corona charger 12 to a charge of a first polarity. The uniformly charged surface is imagewise exposed, for example, by a laser 14 to create an electrostatic image. The electrostatic image is toned by one or both of toning stations 16 and 18 to create a toner image. The toner image is transferred at a transfer station 22 to a receiving sheet fed from a receiving sheet supply 20 by the application of electrical field, for example, an electrical field created by a corona charger 21. The receiving sheet with the toner image is separated from the image member 10 by an air puffer 24 and transported by transport 26 to a fuser 28 where the image is fixed and, ultimately, fed to an output tray 30. The surface of image member 10 is continuously cleaned by cleaning device 32. Biases are applied to the toning stations 16 and 18 by a bias control device 40.

The image forming apparatus shown in FIG. 1 is used to make a two-color toner image with a single pass of image member 10 past the toner image forming stations 12, 14, 16, 18 and 22. Utilizing conventional tri-level xerography, this would be accomplished with an exposure utilizing laser 14, which places the portions of the image that are intended to be toned with a first color toner at a high potential. The portions that are intended to be toned with a second color toner are placed at a low potential. The background is placed at a middle potential. Although this can be done in an optical copier, it is much easier to accomplish in a printer or electronic copier in which the exposure is accomplished by a laser, LED printhead, or the like, from an electronic signal. In conventional tri-level xerography, opposite polarity toners are used to tone the high and low potentials, with careful bias control attempting to maintain clean the middle potential background. This has the disadvantage discussed above of creating a multicolor image with different polarity toners which are difficult to transfer.

Figure 2:
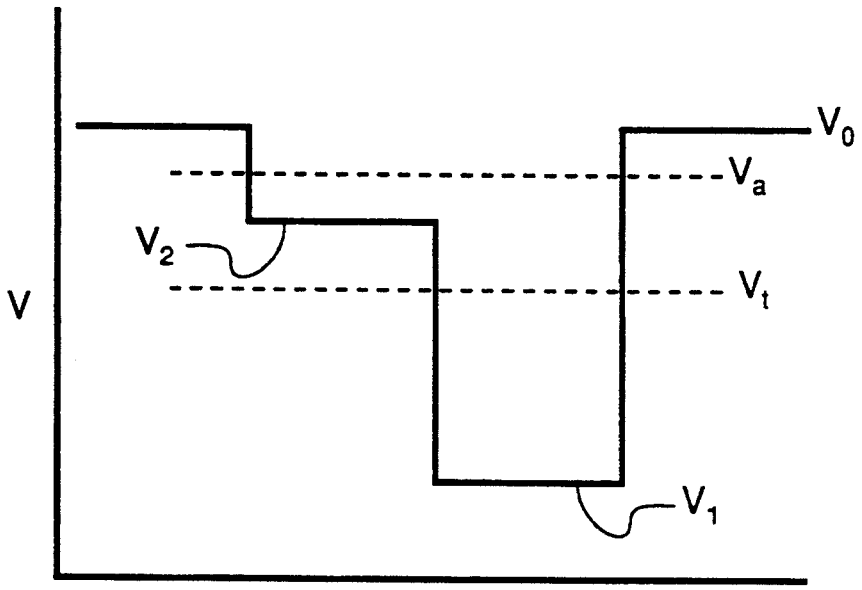
FIGS. 2 and 3 are graphs plotting voltage against position on an image member for alternative embodiments of the invention.

According to the invention, applicant has succeeded in forming two-color toner images in a single pass while using toners of the same polarity, thereby providing a two-color toner image that is more readily transferred. Referring to FIG. 2, a voltage pattern for use with discharged area development (DAD) is illustrated. Charger 12 charges image member 10 to a high potential $V_0$. The textural material in the original is discharged by laser 14 to as low a potential as possible, denoted $V_1$ in FIG. 2. A portion of the image to be highlighted in a second, preferably lighter, color is discharged to an intermediate or medium potential denoted $V_2$ in FIG. 2.

This electrostatic image, created by laser 14 and charger 12, is toned by toning stations 16 and 18. Toning station 16 contains a dark toner, such as black, blue, red, a dark cyan, etc., for toning the textural portion of the image. The toner is charged to the same polarity as the image, that is, the same polarity as $V_0$. The bias on development station 16 is set by bias control 40, connected to an applicator 46 in station 16 at the level shown in FIG. 2 denoted $V_t$. This bias level urges toner toward the portions of the image $V_1$ in FIG. 2 but away from the portions of the image $V_2$ and $V_0$. This creates a dark text toner image on image member 10.

The electrostatic image, with the text toner image, for example, a black textural image, then moves to toner station 18 which includes a light toner, also of the same polarity as the electrostatic image and as the textural toner image. It is of a light color, for example, yellow, a light orange, a light green, a light pink, etc. Toner station 18 applies toner to the electrostatic image with the bias set by bias control 40 attached to an applicator 48 in station 18 at a level noted in FIG. 2 as $V_a$. With the bias set at this level, an electric field is created in the toning area of station 18 that urges light colored toner to both $V_2$ and $V_1$ portions of the image, but urges such toner away from the $V_0$ portions of the image. The result is an image with the text in a dark color, for example, black, but with highlighting in the light color. Some of the light color is superposed on the textural material as a result of toning with light color toner in the $V_1$ areas. This is much the same result obtained when highlighting with a normal hand highlighter. If the textural material is black, a light highlight is not noticeable. If the textural material is in a medium cyan or other similar additive but dark color, a change in hue of the text occurs. For example, highlighting with yellow over cyan will produce a greenish tinge to the textural material to the extent of the highlighting. Both of these results are shown in some of the working examples.

Figure 3:
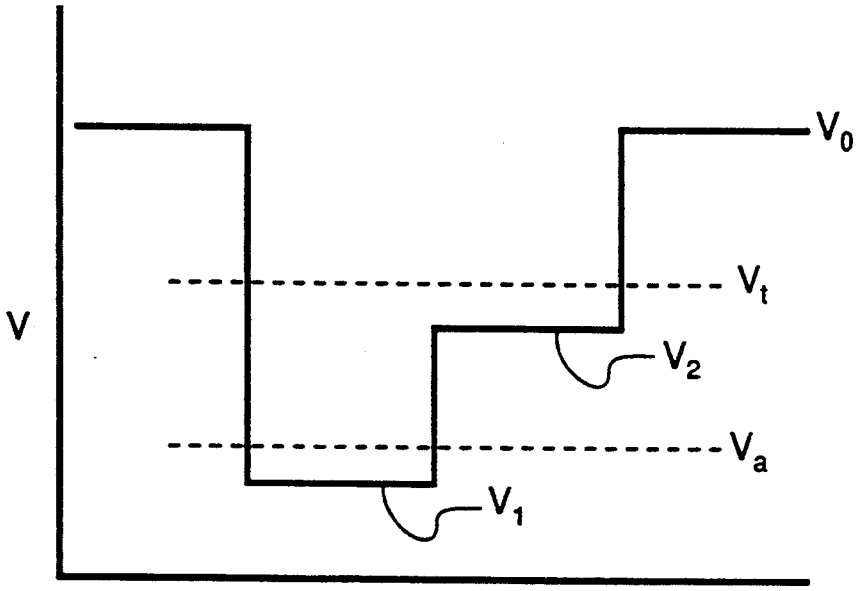

According to FIG. 3, the process can also be used with charged area development (CAD). In this instance, charge is applied by charger 12 to a voltage $V_0$, as in FIG. 2. The background (white) areas of the image are exposed to a low potential $V_1$ which, again, is preferably as low as image member 10 and can be reduced in voltage by reasonable exposure. The highlight areas of the image are exposed to a medium potential $V_2$.

Toning stations 16 and 18 now both contain toner of a polarity opposite to that of $V_0$ to do charged area development. Toning station 16 includes a dark toner and is biased to a level shown in FIG. 3 as $V_t$ which is slightly above $V_2$. The bias $V_t$ creates a field of a direction and strength urging toner toward the $V_0$ portion of the image but away from the $V_1$ and $V_2$ portions of the image. This creates a textural toner image in the dark color in the portions that were originally $V_0$. Toning station 18 includes a light colored toner also of a polarity opposite to $V_0$. Toning station 18 is set to a bias level shown in FIG. 3 as $V_a$. This creates an electric field of a direction and magnitude which urges toner toward both the areas at a $V_0$ level and the areas at a $V_2$ level in the electrostatic image and away from the low, $V_1$ areas. This creates essentially the same two-color toner image created in FIG. 2, although of an opposite polarity toner to that of $V_0$.

In both FIGS. 2 and 3 embodiments, the toner of both colors is of the same polarity and can be readily transferred to a receiving sheet using a corona at transfer station 22 biased to a polarity opposite that of the toner. No special treatment of the toner image to change polarity is necessary. Other electrostatic transfer methods, for example, using a roller to create an electrostatic field, are usable in the same way.

As an example of the invention, the invention was successfully demonstrated in the laboratory as follows:

EXAMPLE 1

A photoconductor was positively charged to 450 volts. It was exposed for seven seconds through a 15 step wedge to create an electrostatic image that varied in voltage from about 200 volts to the 450 volts originally applied. The image was developed using a magnetic brush which included a rotating core rotated in a direction opposite the direction of the image and a rotating shell rotated in a direction the same as the image and hard magnetic carrier particles with insulating toner particles. The first development was carded out using a cyan toner having a high charge-to-mass ratio measured at approximately $+66.7\ \mu c/g$. The core in the brush was rotated at 750 rpm and the shell at 30 rpm. Using essentially the same brush, a yellow toner having a charge-to-mass of $+27.1\ \mu c/g$ was used with also a hard magnetic carrier. The core was rotated at 1,500 rpm and the shell at 30 rpm. The bias for the development with the cyan toner was set at +310 volts ($V_t$) and for the yellow development at +380 ($V_a$) volts. The resulting two-color image was transferred using a transfer voltage corona of −1,600 volts. No transfer preparation charging step was used.

The resulting visual image showed a step (which was the highest exposed region and, hence, that approximating $V_1$ in FIG. 2) which was clearly green, i.e., a combination of cyan and yellow toners. As the steps went up (the film exposure was reduced) the hue became increasingly yellow and at step 8 was quite yellow. By step 10, there was only very lightly toned yellow present. The pattern just described was the one to be expected from FIG. 2. That is, at higher exposures of the photoconductor and at the bias voltages applied, both cyan and yellow toner were deposited on the photoconductor (in that order) and subsequently transferred together to paper. At lower exposures (and consequently lower degrees of discharge of the photoconductor) progressively less toner was deposited on the photoconductor until (at step 8) only yellow toner was deposited. Referring to FIG. 2, the appropriate higher degree of discharge (to film voltage $V_1$) was achieved with steps 1–3 and the appropriate lower degree of discharge (to film voltage $V_2$) was achieved with step 8.

Utilizing these toners with these biases, one would expose the text, of course, to step 1 to discharge the photoconductor as fully as it will reasonably discharge. For the highlight portion of the image ($V_2$) step 8 should be used for exposure. Note that this demonstrates both an ability to create a two-color image and the effect of the highlight color on the text color. As will be demonstrated with later examples, if the highlight color is yellow and the text is black, no visible change in the textural color is observed. However, it should also be pointed out that a large variety of colors of text can be obtained by proper choice of toners, even though some change from the raw toner color of the text may, with some colors, be observed.

EXAMPLE 2

Example 2 was conducted substantially as Example 1, except that different toners were used. The cyan toner for Example 2 had a charge-to mass ratio of 27.8, while the charge-to-mass ratio of the yellow toner was 29.8. The yellow toner was more highly pigmented than that of Example 1.

The carriers were the same as for Example 1, and each developer had been exercised for 10 to 15 minutes on a bottle brush at 2,000 rpm prior to use.

In this example step 10 was toned faintly yellow, step 9 was toned distinctly yellow and step 8 was yellow with a greenish cast. Steps 7–1 became progressively greener with increasing amounts of cyan toner. This example demonstrates that, in addition to the bias voltages used at the development stations, both the charge-to-mass ratio of the toner and the pigment content of the toner can be used to adjust the image densities in the text and highlight areas. All three parameters can be adjusted readily according to the skill in the art, depending on the result desired.

EXAMPLE3

Example 3 involved a photoconductor film that was charged to −450 V and black and yellow toners that were also charged negatively (the black and yellow charge-to-mass ratios were −64.0 and −76.4, respectively). The photoconductor film was, again, discharged to various degrees by exposing it to light through a 15 step wedge of varying densities. After such exposure, the photoconductor was first toned with the black toner (with the bias set at −310 V, the core rotating at 750 rpm against the film direction and the shell rotating at 20 rpm with the film direction). Then, the photoconductor was toned with the yellow toner (with the bias set at −430 V, the core rotating at 1500 rpm against the film direction and the shell rotating at 20 rpm with the direction of film travel). Then, both the black and yellow toners were transferred to paper that was biased at +2000 V versus the film. Again, no pre-transfer charging step was used.

The transferred image was unexpected. In the highly discharged areas (steps 1–4) black toner predominated. In the intermediately discharged areas (steps 5–8) there was a transition from black to yellow. Step 9 was entirely yellow and well toned. Steps 10–12 were also yellow but toned increasingly less. Referring to FIG. 2 and allowing $V_0$ to be a highly negative voltage and the biases to be set approximately as shown, the highly discharged areas were toned first with black, then (a little) yellow toner and the lightly discharged areas were toned only with yellow toner. Black text with yellow highlighting can be obtained with these materials and voltages by exposing the text to a step 1 level and the highlight area to a step 9 level.

The invention has been described in detail with particular reference to a preferred embodiment thereof, but it will be understood that variations and modifications can be effected within the spirit and scope of the invention as described hereinabove and as defined in the appended claims.

I claim:

1. Apparatus for creating two-color images in a single pass, said apparatus comprising:

means for forming an electrostatic image having at least three levels of electrostatic potential of a single polarity, means for applying a first toner of a first color and a first polarity to said electrostatic image in the presence of a first electric field urging said first toner image away from two of said three levels of potential and toward the other level of potential, and means for applying a second toner of a second color and said first polarity to said image in the presence of a second electric field urging said second toner away from one of said three levels of potential and toward at least one of said levels of potential.

2. The apparatus according to claim 1 wherein said means for applying a first toner and said means for applying a second toner are each magnetic brush toning apparatus and said electric fields are created by applying biases to said magnetic brush toning apparatus with respect to said electrostatic image.

3. Image forming apparatus according to claim 1:

wherein said image forming means includes a photoconductive image member movable past a plurality of stations, means for uniformly charging the image member to a first potential $V_0$ and means for imagewise exposing the image member to reduce the level of charge to two levels below $V_0$, $V_1$ and $V_2$ with $V_2$ having a potential between $V_1$ and $V_0$, wherein said means for applying a first toner includes a magnetic brush development device and means for applying a bias $V_t$ to said magnetic brush development device having a potential below $V_2$ but above $V_1$, and wherein said second toner applying means is a magnetic brush development device which includes means for applying a bias $V_a$ to said device having a potential above $V_2$ but below $V_0$ and wherein $V_0$, $V_1$ and $V_2$ are different levels of potential and are of the first polarity.

* * * * *